US009124988B2

(12) United States Patent
Theill et al.

(10) Patent No.: US 9,124,988 B2
(45) Date of Patent: Sep. 1, 2015

(54) HEARING AID WITH ADAPTIVE NOISE REDUCTION AND METHOD

(71) Applicant: Widex A/S, Lynge (DK)

(72) Inventors: Jesper Theill, Lynge (DK); Carsten Paludan-Müller, Frederikssund (DK)

(73) Assignee: Widex A/S, Lynge (DK)

( * ) Notice: Subject to any disclaimer, the term of this patent is extended or adjusted under 35 U.S.C. 154(b) by 23 days.

(21) Appl. No.: 14/193,429

(22) Filed: Feb. 28, 2014

(65) Prior Publication Data

US 2014/0177889 A1 Jun. 26, 2014

Related U.S. Application Data

(63) Continuation-in-part of application No. PCT/EP2011/065066, filed on Sep. 1, 2011.

(51) Int. Cl.
*H04R 25/00* (2006.01)

(52) U.S. Cl.
CPC ..... *H04R 25/453* (2013.01); *H04R 25/356* (2013.01); *H04R 2225/43* (2013.01)

(58) Field of Classification Search
USPC ..... 381/317, 318, 315, 316, 321
See application file for complete search history.

(56) References Cited

U.S. PATENT DOCUMENTS

| | | | | |
|---|---|---|---|---|
| 2006/0233408 | A1* | 10/2006 | Kates | 381/321 |
| 2010/0177915 | A1 | 7/2010 | Latzel et al. | |
| 2011/0013794 | A1* | 1/2011 | Hau et al. | 381/321 |

FOREIGN PATENT DOCUMENTS

| | | | |
|---|---|---|---|
| EP | 1773099 | A1 | 4/2007 |
| WO | 03/007654 | A1 | 1/2003 |
| WO | 2005/051039 | A1 | 6/2005 |
| WO | 2010/028683 | A1 | 3/2010 |
| WO | 2010/083879 | A1 | 7/2010 |

OTHER PUBLICATIONS

Helen Connor, "Hearing Aid Amplification at Soft Input Levels", PHD Thesis, Technical University of Denmark 2009.
International Search Report with Written Opinion for PCT/EP2011/065066 dated Oct. 5, 2012.
International Preliminary Report on Patentability for PCT/EP2011/065066 dated Nov. 20, 2013.

* cited by examiner

*Primary Examiner* — Fan Tsang
*Assistant Examiner* — Hoang H Nguyen
(74) *Attorney, Agent, or Firm* — Sughrue Mion, PLLC

(57) ABSTRACT

A method of noise reduction of low-level input signals in a hearing aid involves applying compression to the input signal using a first compression ratio if a detected measure of amplitude modulation in the input signal is below a selected modulation level, and using a second compression ratio if the measure of amplitude modulation is above the selected modulation level. This reduces the volume of low-level steady-state noise while increasing the volume of modulated signals, e.g. speech. A hearing aid having a noise reduction system (10) has means for determining a level of amplitude modulation from a noise level and an absolute average level of an input signal, and comprises a dynamic compressor having a first compression ratio and a second compression ratio. The means for determining the level of amplitude modulation is configured to control the dynamic compressor in such a way that, below a predetermined input level, unmodulated sounds are amplified less than unmodulated sounds. In this way, low-level, unmodulated sounds are dampened by the hearing aid.

13 Claims, 5 Drawing Sheets

HEARING AID WITH ADAPTIVE NOISE REDUCTION AND METHOD

CROSS REFERENCE TO RELATED APPLICATIONS

The present application is a continuation-in-part of International application No. PCT/EP2011065066, filed on Sep. 1, 2011, published as WO-A1-2013029679, and incorporated by reference herein in its entirety.

BACKGROUND OF THE INVENTION

First-time hearing aid users and individuals with mild to moderate hearing losses often have trouble getting used to the experience of the hearing aid amplifying everything, including low-level sounds, especially in quiet surroundings. This is not a problem when the soft-level sounds reproduced by the hearing aid are wanted by the hearing aid user, but it may become a problem when the sounds from refrigerators, ventilators, water pipes, engines or even the hearing aid itself are amplified to levels interfering with e.g. the hearing aid user's ability to concentrate on performing a specific task.

1. FIELD OF THE INVENTION

This application relates to hearing aids. More specifically, it relates to hearing aids having means for controlling the dynamics of an output signal. The invention further relates to a method of processing audio signals in a hearing aid.

2. THE PRIOR ART

WO-A1-2003007654 discloses a hearing aid having a plurality of compressors wherein the compression thresholds are below the hearing threshold. This enables a hearing aid user to perceive irregularly occurring sounds while keeping steady noises below the hearing threshold. However, in order to make the hearing aid processor perform in this way, very long attack and release times are needed in the compressors of the hearing aid in order to let faster, sudden sounds through in an otherwise quiet environment while keeping the environmental sounds and the noise of the hearing aid processor itself below the hearing threshold. This makes it impossible for the compressor to be able to reproduce softer, modulated sounds like paper rustling, low-level speech, approaching steps, faint birds etc. at levels above the hearing threshold. These sounds are kept below the hearing threshold by the prior art compressor even though they may be valuable to the hearing aid user.

It might be imagined that the problem could be alleviated by employing shorter attack- and release-times in the compressors utilized in the hearing aid. Unfortunately, this would also increase the level of steady, unmodulated noises such as ventilators, refrigerators or traffic noise in the sounds reproduced by the hearing aid. Recent studies ("Hearing aid amplification at soft input levels" PhD thesis, Connor, 2009) have shown that a combination of fast compression combined with a low compression threshold yields unsatisfactory results to hearing aid users, especially in situations where speech is accompanied by background noise. This combination of compression characteristics often results in overamplification of soft sounds, which, in turn, results in the background noise becoming too loud in relation to the speech.

Connor proposes utilizing a hearing aid incorporating a speech detection algorithm, common in contemporary hearing aids, and a compressor controlled by the speech detection algorithm in such a way that a low compression threshold is employed whenever speech is detected, and a higher compression threshold is employed whenever steady-state noise is detected. In this way, the noise would not activate the compressor in the hearing aid at lower input levels, and thus not be amplified by the compressor, whereas speech signals at comparative input levels would trigger the compressor and therefore be adequately amplified.

A hearing aid having the capability to differentiate between speech and noise, i.e. between modulated and unmodulated sounds at low to medium levels, and having the means to use this capability to enhance modulated sounds and suppress unmodulated sounds at these sound levels, is thus desired. One feature of the invention is therefore to devise a hearing aid wherein low-level modulated sounds in general, not just low-level speech sounds, control the compression scheme of the hearing aid. This would allow fast compression to be used whenever irregular sounds were present without providing too much amplification to constant noise sources.

SUMMARY OF THE INVENTION

In a first aspect, the invention, devises a method of processing audio signals in a hearing aid having an acoustic input transducer, a signal processor and an output transducer, said method comprising the steps of splitting an input signal from the input transducer into a plurality of frequency bands, deriving an absolute average level of each frequency band of the input signal, deriving a noise level of each frequency band of the input signal, selecting an amplitude modulation level, determining a measure of amplitude modulation from the noise level and the absolute average level, in respect of each frequency band of the input signal, providing a frequency band dynamic compressor with a first compression ratio and a first compression threshold, and a second compression ratio and a second compression threshold, and applying compression to the input signal in each frequency band using the highest of the first and second compression ratios and the highest of the first and second compression threshold whenever the determined amplitude modulation is below the selected modulation level, and the lowest of the first and second compression ratio and the lowest of the first and second compression threshold whenever the determined amplitude modulation is above the selected modulation level.

This method enables the hearing aid to distinguish between unmodulated sounds and modulated sounds, and dampen unmodulated sounds below a predetermined level by a specified amount.

In a preferred embodiment, the predetermined level of the input signal is selected from a plurality of predetermined levels in dependence of a measured hearing threshold level of a hearing aid user. Thus, a fitter of the hearing aid may adjust the compression threshold level in such a way that the level of unmodulated sounds below the predetermined level is reduced to a level below the hearing threshold level of the hearing aid user.

The invention, in a second aspect, devises a hearing aid comprising an acoustic input transducer, a signal processor and an output transducer, said signal processor comprising means for splitting an input signal from the acoustic input transducer into a plurality of frequency bands, means for deriving, in respect of each frequency band, a noise level and an absolute average level, respectively, means for calculating a measure of amplitude modulation from the noise level and the absolute average level, in respect of each frequency band of the plurality of frequency bands, and a frequency band dynamic compressor having a first compression ratio and a first compression threshold, and a second compression ratio and a second compression threshold, said amplitude modulation determining means being adapted to control the dynamic compressor in such a way that the highest of the first and the second compression ratios and the highest of the first and the second compression thresholds are used whenever the determined amplitude modulation is below a predetermined modulation level, and the lowest of the first and the second compression ratios and the lowest of the first and the second compression thresholds are used whenever the determined amplitude modulation is above the predetermined modulation level.

This effectively provides a hearing aid where unmodulated sounds below a certain level are dampened for the comfort and benefit for the hearing aid user, while modulated sounds, or sounds above said certain level, are amplified by the hearing aid according to the hearing aid prescription for reproduction to the user.

Further features and advantages are apparent from the dependent claims.

People suffering from a hearing impairment have various degrees of difficulty perceiving sounds. Some may have a loss of treble or high frequencies while others may have a loss of bass or lower frequencies. Still others may suffer from more complex hearing impairments involving e.g. both the treble and the midrange frequencies, while their hearing capability may approach that of normal-hearing persons at low frequencies.

Modern hearing aids are designed to compensate for a wide range of hearing impairments, primarily by providing an extra measure of amplification of input signals to the hearing-impaired ear across the frequency ranges where hearing is impaired. There is, however, a limit to the amount of amplification which may be applied in order to compensate for a given hearing loss. Physiologically, a hearing loss affects what is known as the hearing threshold level, abbreviated HTL. This level is, by definition, the lowest level at which sound may be perceived by an individual. The more severe a hearing loss is at a given frequency range, the higher the HTL is. The highest sound pressure level (SPL) which may be endured by an individual is denoted the upper comfort level, or UCL. This level does not change when a person experiences a hearing loss. In other words, if an input signal of a given strength is amplified by a hearing aid to an SPL higher than the UCL, discomfort is experienced by the hearing aid user.

Therefore, modern hearing aids usually employ some form of nonlinear amplification, such as dynamic compression, when compensating a hearing loss in order to ensure that the SPL output from the hearing aid does not exceed UCL. Low-level input signals may thus receive more amplification than high-level input signals, effectively reducing the dynamic range of the output signals reproduced by the hearing aid.

Prior to the following discussion, some assumptions about the signal levels present in hearing aids have to be made. As noted in the foregoing, the lowest perceivable sound pressure level is the hearing threshold level, HTL, and the highest endurable sound pressure level is the upper comfort level, UCL. For a given hearing loss the HTL becomes higher while the UCL stays the same. It is a key purpose of a hearing aid to amplify input signals to a level above HTL without ever reaching or exceeding UCL. Other level limits may be defined within the limits of HTL and UCL for specific purposes. For convenience, a sound pressure level between HTL and UCL is denoted normal speech level, NSL. This level is defined as the level limit of average speech in such a way that everything above this limit is considered "loud", and everything below this limit is considered "soft", i.e. perceivable by the hearing-impaired user but at a level below average speech. In this context, the "soft" levels between HTL and NSL are the subject of the noise reduction system of the invention.

Due to the fact that the noise reduction system should only be active whenever the hearing aid user is in a quiet sound environment, a preferred detection method for the noise reduction system of the invention is the inclusion of an environmental classifier in the hearing aid. Such classifiers are, e.g., known from WO-A1-2005/051039 and are used to determine the character of the sound environment the user is experiencing for the purpose of optimizing the signal processing in the hearing aid to different listening situations.

Several different methods exist in determining and classifying various parameters in the sound environment. One tried and tested method involves deriving a set of percentile values from the input signal, preferably a 10% percentile value and an abs-average value, and utilizing the percentile values to determine a noise level, a peak level and a modulation level of the input signal. The noise level is defined as the instantaneous 10% percentile level, the peak level is defined as the instantaneous abs-average level, and the modulation level is defined as the difference between the abs-average level and the 10% percentile level.

The 10% percentile value and the abs-average value derived from the input signal serve as the basis for the calculation of the input-output transfer function of the noise reduction system. In the following, the actual reduction of unmodulated, low-level sounds is denoted squelch in order to distinguish it from other types of gain reduction applied in a hearing aid. For the purpose of defining the various knee-points and slopes of the resulting input-output transfer function, a set of constant values have to be determined.

The noise reduction of the hearing aid is supposed to be working at input levels below the normal speech level NSL. In order to prevent a steep transition from the range of levels where the squelch is operating to the range of levels where the normal compression rationale takes over, a transition band, denoted SqRng, is defined. The SqRng constant is calculated as:

$$SqRng = 30 - \frac{HTL}{8}$$

The level where the squelch completely ceases to be active, i.e. the highest level of SqRng, is another constant denoted SqEnd. The constant SqEnd is calculated as:

$$SqEnd = NSL - \left(20 - \frac{HTL}{20}\right)$$

When the difference between the 10% percentile level and the abs-average level is low, then the modulation of the input signal is low. As stated in the foregoing, the noise reduction system utilizes the modulation level of the input signal to distinguish modulated sounds from unmodulated sounds. The modulation level at which the difference between the percentile levels is low enough for the squelch to start reducing the gain of the input signal is a constant denoted SqSum. Whenever the modulation level gets below SqSum, the noise reduction system determines that the input signal is "unmodulated", and thus deemed to be noise.

In order to address the potential problem of the noise reduction system reacting too slow on modulated sounds the noise reduction system performs a fast and "aggressive" suspension of the squelch when impulses and modulated sounds are detected. A dedicated constant determining the "aggressivity" of the squelch suspension is denoted SqAggr. By applying a larger value of SqAggr to this part of the noise reduction system at the time of fitting the hearing aid to a user an even faster squelch suspension may be obtained. A lower value for SqAggr may be used if too many artifacts are encountered by the user.

In a preferred embodiment of the invention, the absolute limits of gain applied to the input signal by the noise reduction system may be defined, at one hand, by the amount of extra gain applied to impulses and modulated sounds, and, at the other hand, the maximum amount of squelch applied to unmodulated sounds in order for those sounds to be dampened. The constant defining the maximum allowable amount of extra gain is denoted SqPU and the constant defining the maximum allowable amount of squelch is denoted MaxSq.

The output gain applied to sounds below NSL by the noise reduction system may thus be expressed as:

$$\left(\frac{(SqEnd - P_{10})}{SqRng}\right)\cdot((P_{10} - |Avg| + SqSum)\cdot SqAggr) = G_{out}$$

where $$(SqEnd - P_{10}) \geq 0;$$

$$\left(\frac{SqEnd - P_{10}}{SqRng}\right) \leq 1;$$

and $$SqPU \leq ((P_{10} - |Avg| + SqSum)\cdot SqAggr) \leq MaxSq.$$

$P_{10}$ is the 10% percentile, |Avg| is the absolute average level, and $G_{out}$ is the gain applied to the input signal. When the input sound level is below NSL the noise reduction system reduces the gain applied to unmodulated sounds and increases the gain applied to modulated sounds and impulses. Whenever the input sound level given by the 10% percentile is above NSL the noise reduction system is inactive and the normal hearing aid compression system performs the gain control of the input signal.

In order to ensure compatibility between the compression scheme of the noise reduction system according to the invention and the compression scheme utilized by the hearing aid at listening levels above NSL, the gain curve of the noise reduction system is calculated from the fitting rationale normally used by the hearing aid. One preferred way of calculating the new gain curve $IG_{new}$ from the original gain curve IG is as follows:

Firstly, the Cross point, i.e. the point where the input-output gain curve crosses the ordinate in an input-output gain coordinate system is calculated as:

$$\text{Cross} = IG + NSL - \frac{NSL}{cr1}$$

Then the new cr1 is calculated from the original:

$$cr1_{new} = \frac{cr1}{2} + 0.5$$

The new gain curve may then be calculated as:

$$IG_{new} = 0.9\cdot\text{Cross} + \frac{NSL}{cr1_{new}} - NSL$$

Preferably, this calculation is carried out during fitting of the hearing aid and the result is stored in the hearing aid memory.

BRIEF DESCRIPTION OF THE DRAWINGS

The invention will now be described in more detail with respect to the drawings, where.

DETAILED DESCRIPTION OF THE INVENTION

Figure 1:
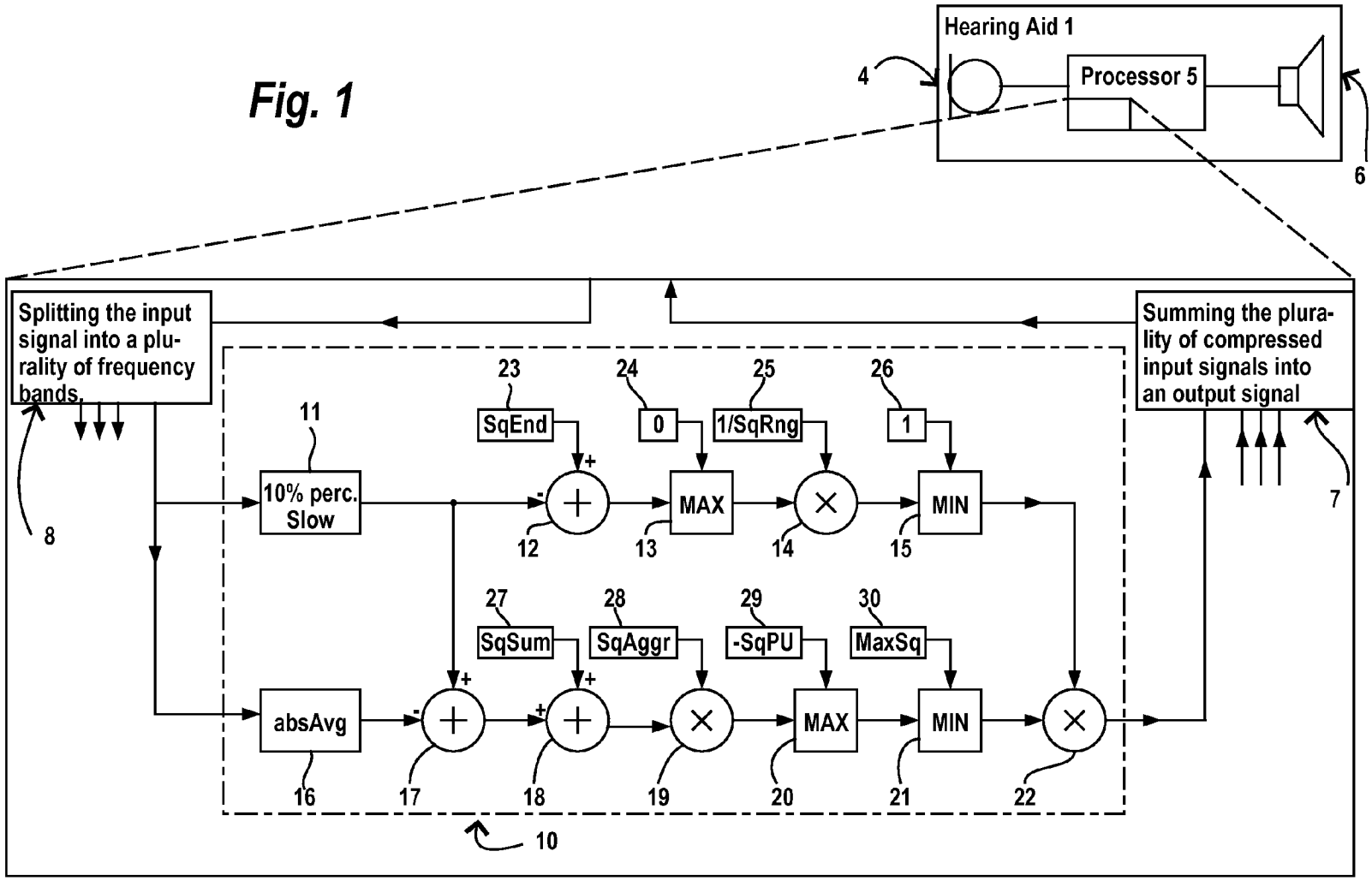
FIG. 1 is a block schematic of a noise reduction system according to an embodiment of the invention.

FIG. 1 shows a block schematic of a noise reduction system 10 according to an embodiment of the invention. The noise reduction system 10 is contained in a processor 5 of a hearing aid 1. The hearing aid 1 further includes an input transducer 4 and an output transducer 6. The processor includes means 8 for splitting an input signal from the input transducer 4 into a plurality of frequency bands handled by respective noise reduction systems 10, and means 7 for summing the plurality of compressed input signals from respective noise reduction systems 10 into an output signal to be presented to the output transducer 6 of the hearing aid 1.

The purpose of the noise reduction system 10 is to generate an instantaneous gain value based on an analysis of the 10% percentile and the abs-average values derived from the input signal of the hearing aid. The noise reduction system 10 comprises a 10% percentile detector 11, a first difference node 12, a first maximum comparator block 13, a first multiplier 14, a first minimum comparator block 15, an abs-average detector 16, a second difference node 17, a summing node 18, a second multiplier node 19, a second maximum comparator block 20, a second minimum comparator block 21 and a third multiplier 22. Also shown in FIG. 1 is eight constant blocks 23, 24, 25, 26, 27, 28, 29, and 30. The interconnections and functionality of the noise reduction system 10 will be described in further detail in the following.

The 10% percentile detector 11 takes the hearing aid input signal and extracts an instantaneous 10% percentile value from the input signal. The 10% percentile value represents the noise floor of the input signal. The output from the 10% percentile detector 11 is split between the first difference node 12 and the second difference node 17. The 10% percentile signal is subtracted from the first constant block 23 in the first difference node 12. The first constant block 23 holds the constant SqEnd representing the input level where the squelch function ceases to be active. The result from the difference node 12 is compared to zero, taken from the second constant block 24, in the first maximum comparator block 13. The result from the first maximum comparator block 13, which is always positive, is used as the input signal for the first multiplier 14, where it is divided by SqRng, taken from the third constant block 25. The constant SqRng represents the level distance from SqEnd to the point where the squelch is completely active. The output from the first multiplier 14 is used as the input for the first minimum comparator block 15, where the input signal is compared to unity. The output from the first minimum comparator block 15 is thus always a number between zero and one, and is used as the first input signal for the third multiplier 22.

The abs-average detector 16 takes the hearing aid input signal and extracts an instantaneous abs-average value from the input signal. The abs-average value represents the signal peak level of the input signal. In the second difference node 17, the abs-average value is subtracted from the 10% percentile value, and the result is added to the constant SqSum, taken from the fifth constant block 27, in the summation node 18. The constant SqSum represents the minimum level difference between the 10% percentile and the abs-average value before the squelch initiates.

The output from the summation node 18 is multiplied by the constant SqAggr, taken from the sixth constant block 28, in the second multiplier block 19, and the result is presented to the second maximum comparator block 20. The constant SqAggr represents the "aggressiveness" of the squelch suspension employed by the noise reduction system 10. The higher the value of SqAggr is, the faster and deeper the squelch is suspended.

In the second maximum comparator 20 the output signal from the second multiplier block 19 is compared to the constant −SqPU, taken from the seventh constant block 29, and the output from the second maximum comparator block 20 is presented as the input signal for the second minimum comparator block 21. The constant SqPU represents the maximum squelch pull-up over-gain allowed for modulated sounds, i.e. how much modulated, low-level sounds are amplified with respect to the overall sound level. The second maximum comparator block 20 thus ensures that its output signal cannot become lower than −SqPU.

In the second minimum comparator block 21, the output signal from the second maximum comparator block 20 is compared against the constant MaxSq, taken from the eighth constant block 30. The constant MaxSq determines the highest allowable gain reduction for unmodulated sounds, i.e. unmodulated sounds may not be dampened more than MaxSq by the system. The output of the second minimum comparator block 21 is used as the second input signal for the third multiplier 22. The output signal from the third multiplier 22 is also the output from the noise reduction system 10 and is the product of the first minimum comparator block 15 and the second minimum comparator block 21 representing the instantaneous gain value calculated by the noise reduction system of the hearing aid according to the invention.

Figure 2:
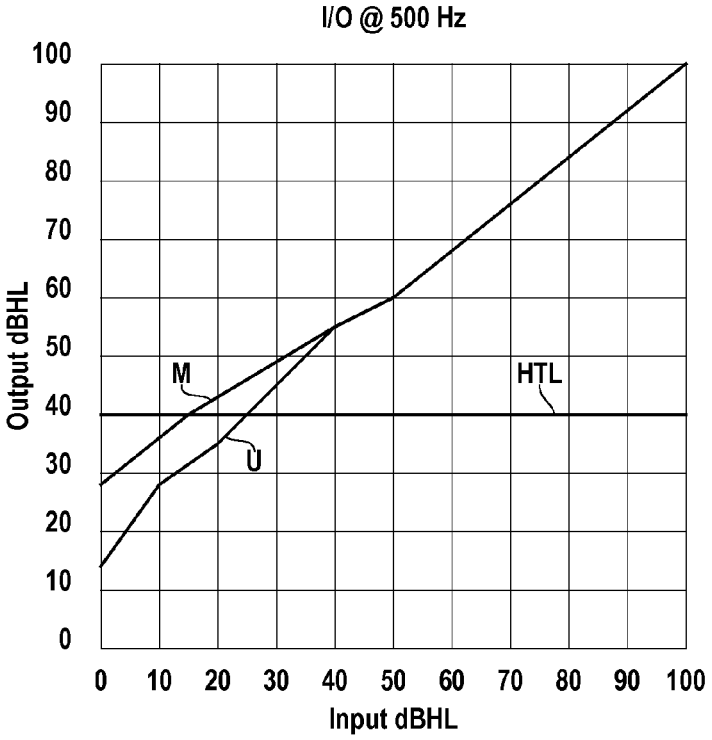
FIG. 2 illustrates a first compression characteristic at 500 Hz of the noise reduction system according to an embodiment of the invention.
Figure 3:
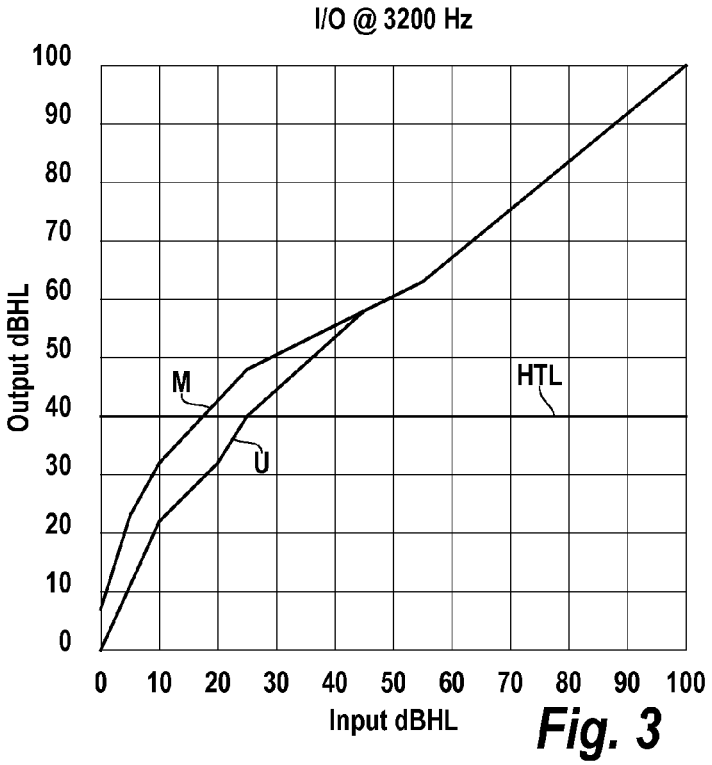
FIG. 3 illustrates a first compression characteristic at 3200 Hz of the noise reduction system according to an embodiment of the invention.

FIGS. 2-7 are graphs showing exemplified input-output characteristics of an embodiment of the noise reduction system of the hearing aid according to the invention at different frequencies and with respect to a range of various hearing threshold levels. FIGS. 2 and 3 shows the input-output characteristic of the noise reduction system operating at a frequency of 500 Hz and a frequency of 3200 Hz, respectively, at a measured hearing threshold level of 40 dB. In FIG. 2, a first graph representing the input-output characteristic applied to modulated signals at 500 Hz is denoted M, and a second graph representing the input-output characteristic applied to unmodulated signals at 500 Hz is denoted U. The hearing threshold level of 40 dB is shown as a third graph, denoted HTL.

As may be learned from the graphs in FIG. 2, the level of amplification applied to modulated sounds is larger than the level of amplification applied to unmodulated sounds at input levels below 40 dB. At input levels above 40 dB, the same level of amplification is applied to both modulated and unmodulated sounds, and the two graphs thus coincide at the input-output point [40 dB, 55 dB], i.e. when the input level is 40 dB, the output level is 55 dB. The net effect of this compression characteristic is that modulated sounds are amplified more than unmodulated sounds at input levels below 40 dB. At 500 Hz, modulated sounds are compressed so as to appear above the hearing threshold level when the input level exceeds 15 dB, whereas unmodulated sounds are compressed so as to appear above the hearing threshold level when the input level exceeds 25 dB.

In FIG. 3, a first graph representing the input-output characteristic applied to modulated signals at 3200 Hz is denoted M, and a second graph representing the input-output characteristic applied to unmodulated signals at 3200 Hz is denoted U. As in FIG. 2, the hearing threshold level of 40 dB is shown as a third graph, denoted HTL. At input levels above 45 dB, the same level of amplification is applied to both modulated and unmodulated sounds, and the two graphs thus coincide at the input-output point [45 dB, 58 dB], i.e. when the input level is 45 dB, the output level is 58 dB. The effect of this compression characteristic is that modulated sounds are amplified more than unmodulated sounds at input levels below 45 dB. At 3200 Hz, modulated sounds are compressed so as to appear above the hearing threshold level when the input level exceeds 18 dB, whereas unmodulated sounds are compressed so as to appear above the hearing threshold level when the input level exceeds 25 dB.

If one compares the graphs in FIG. 3 to the graphs in FIG. 2 it may be seen that, at a hearing threshold level of 40 dB, modulated sounds occurring at 3200 Hz are amplified about 3 dB more than modulated sounds occurring at 500 Hz, and unmodulated sounds are dampened more aggressively at 3200 Hz than at 500 Hz. In other words, the separation between modulated and unmodulated sounds is made more profound by the noise reduction system at 3200 Hz than at 500 Hz.

Figure 4:
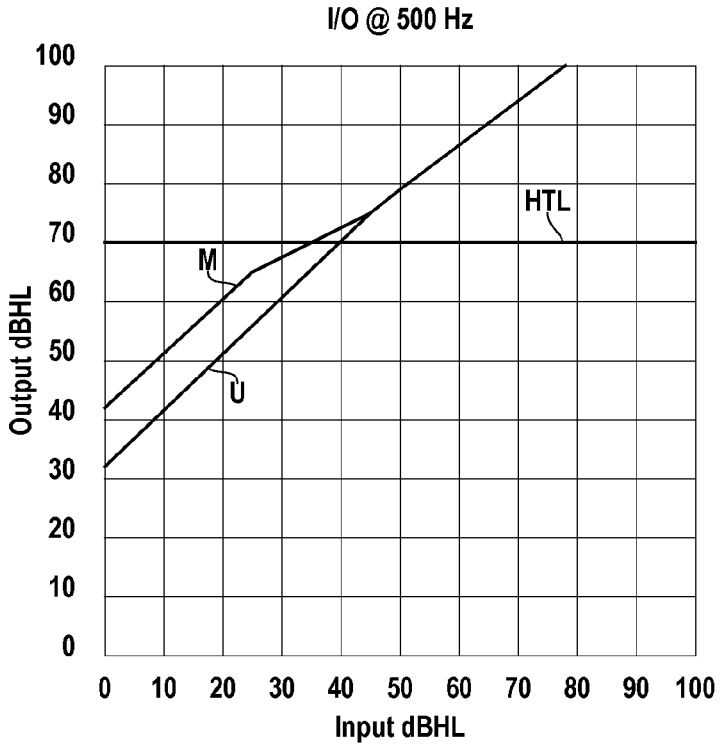
FIG. 4 illustrates a second compression characteristic at 500 Hz of the noise reduction system according to an embodiment of the invention.
Figure 5:
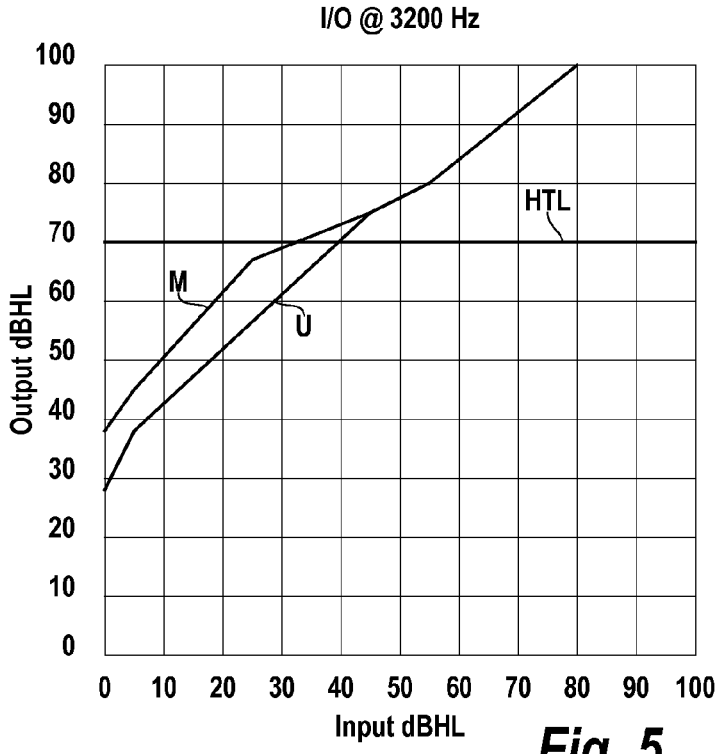
FIG. 5 illustrates a second compression characteristic at 3200 Hz of the noise reduction system according to an embodiment of the invention.

FIGS. 4 and 5 shows the input-output characteristic of the noise reduction system operating at a frequency of 500 Hz and a frequency of 3200 Hz, respectively, at a measured hearing threshold level of 70 dB, corresponding to a profound hearing loss. In FIG. 4, a first graph representing the input-output characteristic applied to modulated signals at 500 Hz is denoted M, and a second graph representing the input-output characteristic applied to unmodulated signals at 500 Hz is denoted U. The hearing threshold level of 70 dB is a third graph, denoted HTL. At input levels above 45 dB, the same level of amplification is applied to both modulated and unmodulated sounds, and the two graphs thus converge at the input-output point [45 dB, 75 dB]. The effect of this compression characteristic is that modulated sounds are amplified more than unmodulated sounds at input levels below 45 dB. At 3200 Hz, modulated sounds are compressed so as to appear above the hearing threshold level when the input level exceeds 32 dB, whereas unmodulated sounds are compressed so as to appear above the hearing threshold level when the input level exceeds 40 dB.

Comparing the graphs in FIG. 5 to the graphs in FIG. 4 it may be seen that, at the hearing threshold level of 70 dB, modulated sounds occurring at 3200 Hz are amplified about 2 dB more than modulated sounds occurring at 500 Hz, and unmodulated sounds are dampened in approximately the same way at both frequencies. Thus, the separation between modulated and unmodulated sounds is made more profound by the noise reduction system at 3200 Hz than at 500 Hz.

When the graphs of FIGS. 4 and 5 are compared to the graphs of FIGS. 2 and 3 it becomes evident that the difference in output level between the HTL and the point where the graph M converges with the graph U is much smaller in FIGS. 4 and 5, where the hearing threshold level is 70 dB, than it is in FIGS. 2 and 3, where the hearing threshold level is 40 dB. This is a feature of the noise reduction system according to the invention in order to ensure that the noise reduction only affects comparatively weak sound levels.

Figure 6:
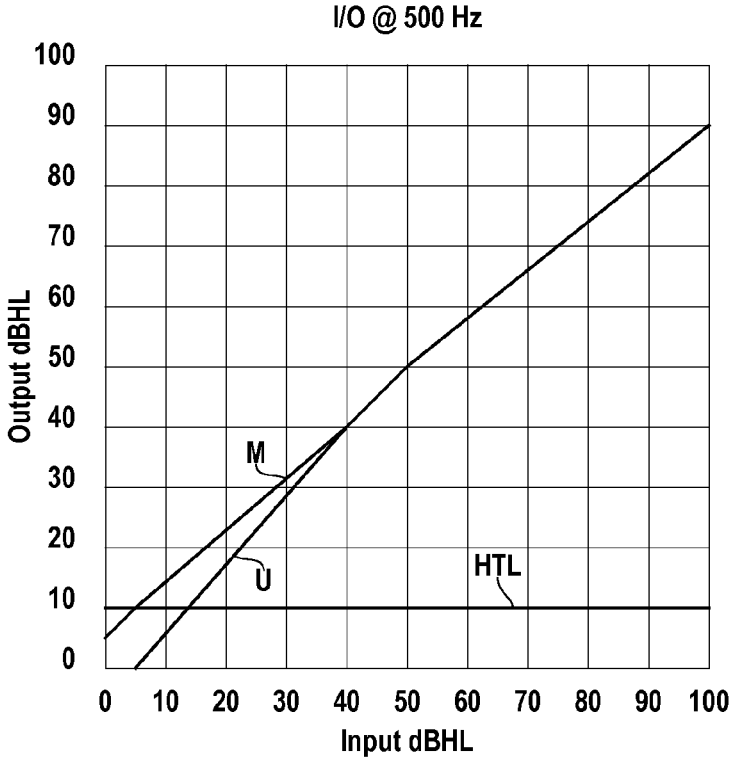
FIG. 6 illustrates a third compression characteristic at 500 Hz of the noise reduction system according to an embodiment of the invention.
Figure 7:
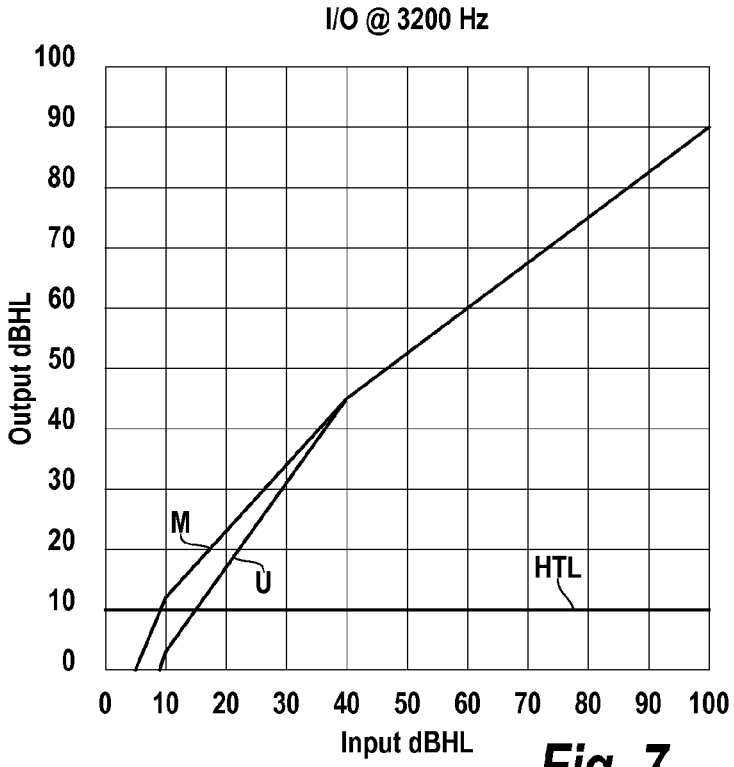
FIG. 7 illustrates a third compression characteristic at 3200 Hz of the noise reduction system according to an embodiment of the invention.

FIGS. 6 and 7 shows the input-output characteristic of the noise reduction system operating at a frequency of 500 Hz and a frequency of 3200 Hz, respectively, at a measured hearing threshold level of 10 dB, corresponding to a light hearing loss. In FIG. 6, a first graph representing the input-output characteristic applied to modulated signals at 500 Hz is denoted M, and a second graph representing the input-output characteristic applied to unmodulated signals at 500 Hz is denoted U. The graph of the hearing threshold level of 10 dB is denoted HTL.

As may be learned from the graphs in FIG. 6, the level of amplification applied to modulated sounds is larger than the level of amplification applied to unmodulated sounds at input levels below 10 dB. At input levels above 10 dB, the same level of amplification is applied to both modulated and unmodulated sounds, and the two graphs thus coincide at the input-output point [40 dB, 45 dB], i.e. when the input level is 40 dB, the output level is 45 dB. The net effect of this compression characteristic is that modulated sounds are amplified more than unmodulated sounds at input levels below 10 dB. At 500 Hz, modulated sounds are compressed so as to appear above the hearing threshold level when the input level exceeds 5 dB, whereas unmodulated sounds are compressed so as to appear above the hearing threshold level when the input level exceeds 14 dB.

In FIG. 7, a first graph representing the input-output characteristic applied to modulated signals at 3200 Hz is denoted M, and a second graph representing the input-output characteristic applied to unmodulated signals at 3200 Hz is denoted U. As in FIG. 6, the hearing threshold level of 10 dB is shown as a third graph, denoted HTL. At input levels above 40 dB, the same level of amplification is applied to both modulated and unmodulated sounds, and the two graphs thus coincide at the input-output point [40 dB, 45 dB], i.e. when the input level is 40 dB, the output level is 45 dB. The effect of this compression characteristic is that modulated sounds are amplified more than unmodulated sounds at input levels below 40 dB. At 3200 Hz, modulated sounds are compressed so as to appear above the hearing threshold level when the input level exceeds 9 dB, whereas unmodulated sounds are compressed so as to appear above the hearing threshold level when the input level exceeds 15 dB.

Comparing the graphs in FIG. 7 to the graphs in FIG. 6 reveals that both modulated and unmodulated sounds are amplified less below input levels of 40 dB at 3200 Hz than at 500 Hz. This implies that both modulated and unmodulated sounds are dampened below 40 dB, but unmodulated sounds are dampened more than modulated sounds, and thus steady-state noise reduction is obtained.

The input-output graphs in FIGS. 2, 3, 4, 5, 6 and 7 illustrates the operation of the noise reduction system according to the invention at different frequencies and for different hearing threshold levels. At sound levels close to and above the hearing threshold level, but below normal speech level, modulated sounds are amplified more than unmodulated sounds. This difference in amplification is maintained at sound levels below the hearing threshold level, but for slight to medium hearing losses, i.e. a hearing threshold level between 10 dB and 40 dB, a more aggressive compression strategy is employed at the lowest sound levels. At sound levels above normal speech levels, the noise reduction system is inactive, relying on the compression scheme dictated by the fitting rationale and the type of hearing loss to be compensated.

Figure 8:
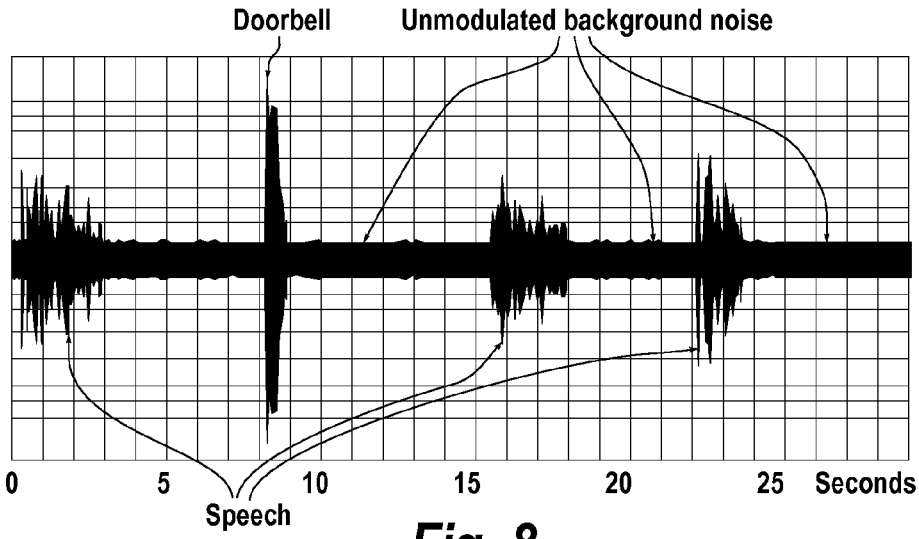
FIG. 8 is a graph showing a sound sample from a hearing aid according to an embodiment of the invention.

FIG. 8 shows a graph of a sound sample of an input signal in a hearing aid according to the invention. In order to illustrate the operation of the noise reduction system of the hearing aid according to the invention, the sound sample in FIG. 8 is shown without the noise reduction system activated. For the first three seconds a speech signal is present, after about eight seconds a doorbell sounds, after approximately sixteen seconds the speech signal is present again, ending after eighteen seconds, and after twenty-two seconds, a final speech effort is detected, lasting for about two seconds. How this input signal is interpreted by the noise reduction system according to the invention will be described in the following, with reference to FIGS. 9 and 10.

Figure 9:
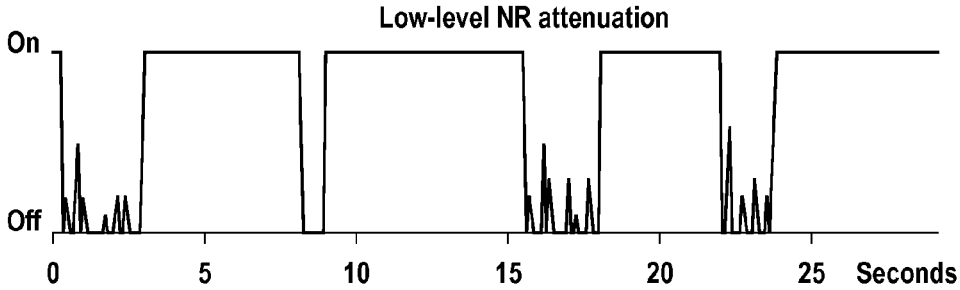
FIG. 9 is graph showing the operation of the noise reduction system of the hearing aid according to an embodiment of the invention.

The graph shown in FIG. 9 is a timing diagram illustrating the operation of the noise reduction system according to the invention with respect to the sample of the input signal shown in FIG. 8. At the start of the timing diagram, the noise reduction is turned off in order to reproduce the speech signal present during the first three seconds of the sound sample. When the speech signal finishes, after about three seconds, the noise reduction is activated again. After about eight seconds, the sound of the doorbell (being highly modulated and loud) triggers deactivation of the noise reduction for a duration of about one second. When the sound of the doorbell ceases, after about nine seconds, the noise reduction is reactivated. The two speech efforts after fifteen seconds and after twenty-two seconds also trigger deactivation of the noise reduction system for the duration of the speech. The noise reduction system modifies the input signal shown in FIG. 8, and the resulting output signal is illustrated in FIG. 10.

Figure 10:
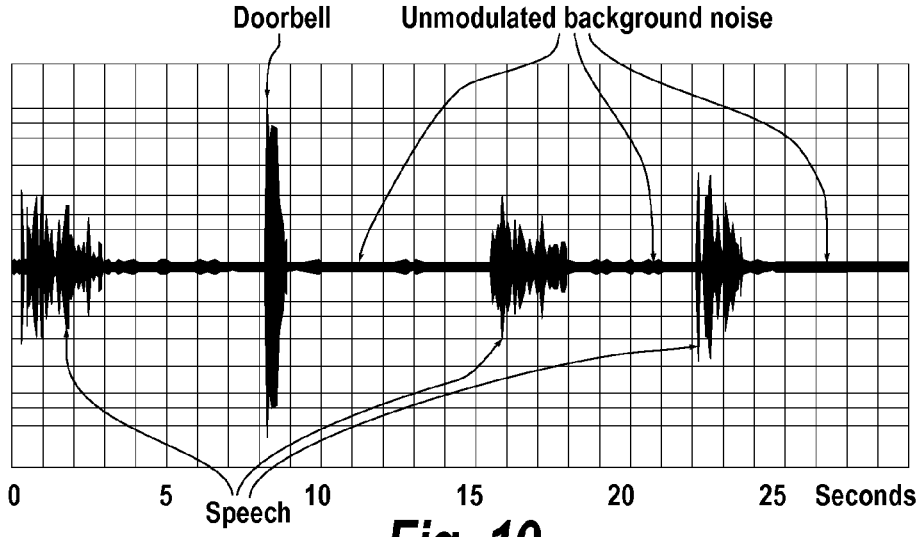
FIG. 10 is a graph showing a sound sample from a hearing aid utilizing the noise reduction system according to an embodiment of the invention.

In the graph of the sound sample in FIG. 10, the effects of applying noise reduction according to the invention on the input signal are evident. When the signal sample is subjected to the noise reduction system, as shown in FIG. 10, the level of the unmodulated background noise is lowered considerably when compared to the untreated signal sample shown in FIG. 8. Modulated sounds, however, are virtually unaffected by the noise reduction system, as may be seen by comparing the three speech efforts and the incident of the doorbell in FIG. 10 with the similar events in FIG. 8.

As may be learned from FIGS. 8, 9 and 10 in combination, the noise reduction system distinguishes between modulated and unmodulated sounds, and reduces the level of unmodulated sounds below a predetermined level by a specified amount, leaving modulated sounds below the predetermined level and modulated and unmodulated sounds above the predetermined level unaltered by the system. This has the effect that steady noise sources, such as ventilators, engines or the like, are dampened while low-level modulated sounds, such as soft speech, are amplified according to the prescription for the hearing-impaired user of the hearing aid according to the invention.

We claim:

1. A method of processing audio signals in a hearing aid having an acoustic input transducer, a signal processor and an output transducer, said method comprising the steps of:

splitting an input signal from the input transducer into a plurality of frequency bands, deriving an absolute average level of each frequency band of the input signal, deriving a noise level of each frequency band of the input signal, selecting an amplitude modulation level, determining a measure of amplitude modulation from the noise level and the absolute average level, in respect of each frequency band of the input signal, providing a frequency band dynamic compressor with a first compression ratio and a first compression threshold, and a second compression ratio and a second compression threshold, and applying compression to the input signal in each frequency band using the highest of the first and second compression ratios and the highest of the first and second compression threshold whenever the determined amplitude modulation is below the selected modulation level, and the lowest of the first and second compression ratio and the lowest of the first and second compression threshold whenever the determined amplitude modulation is above the selected modulation level.

2. The method according to claim 1, wherein said method comprises selecting said second compression threshold being less than 90% of the first compression threshold, and said second compression ratio being less than 50% of the first compression ratio.

3. The method according to claim 1, wherein said method comprises summing the plurality of compressed input signals into an output signal, and presenting the output signal to the output transducer of the hearing aid.

4. The method according to claim 1, wherein the steps of selecting a first compression ratio and a first compression threshold and selecting a second compression ratio and a second compression threshold are performed for each frequency band of the plurality of frequency bands during fitting of the hearing aid.

5. The method according to claim 1, wherein the first compression ratio and the second compression ratio are selected from a plurality of first compression ratios and second compression ratios in dependence of the frequency band of the input signal to be compressed.

6. The method according to claim 1, wherein the step of applying compression to the input signal is performed if the input signal is below a predetermined level.

7. The method according to claim 6, wherein the predetermined level of the input signal is selected from a plurality of predetermined levels in dependence of a measured hearing threshold level of a hearing aid user.

8. A hearing aid comprising an acoustic input transducer, a signal processor and an output transducer, said signal processor comprising means for splitting an input signal from the acoustic input transducer into a plurality of frequency bands, means for deriving, in respect of each frequency band, a noise level and an absolute average level, respectively, means for calculating a measure of amplitude modulation from the noise level and the absolute average level, in respect of each frequency band of the plurality of frequency bands, and a frequency band dynamic compressor having a first compression ratio and a first compression threshold, and a second compression ratio and a second compression threshold, said amplitude modulation determining means being adapted to control the dynamic compressor in such a way that the highest of the first and the second compression ratios and the highest of the first and the second compression thresholds are used whenever the determined amplitude modulation is below a predetermined modulation level, and the lowest of the first and the second compression ratios and the lowest of the first and the second compression thresholds are used whenever the determined amplitude modulation is above the predetermined modulation level.

9. The hearing aid according to claim 8, wherein the dynamic compressor of the signal processor is adapted to apply one among the first and the second compression ratios to signals below a first predetermined signal level.

10. The hearing aid according to claim 8, wherein the dynamic compressor of the signal processor is adapted to apply one among the first and the second compression thresholds to signals below a first predetermined signal level.

11. The hearing aid according to claim 8, wherein the dynamic compressor is adapted to select the first and the second compression ratio from a plurality of stored compression ratios dependent of a predetermined hearing threshold level.

12. The hearing aid according to claim 8, wherein the dynamic compressor is adapted to select the first and the second compression threshold from a plurality of stored compression thresholds dependent of a predetermined hearing threshold level.

13. The hearing aid according to claim 8, wherein the means for calculating a measure of modulation is adapted to control the dynamic compressor by applying modified gain values to the input signal in proportion to the degree of modulation of the input signal.

* * * * *